US008932075B2

(12) United States Patent
Reibke

(10) Patent No.: US 8,932,075 B2
(45) Date of Patent: Jan. 13, 2015

(54) ELECTRICAL CONNECTION DEVICE

(75) Inventor: Heinz Reibke, Bad Salzuflen (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 347 days.

(21) Appl. No.: 13/558,786

(22) Filed: Jul. 26, 2012

(65) Prior Publication Data

US 2013/0029537 A1 Jan. 31, 2013

(30) Foreign Application Priority Data

Jul. 29, 2011 (DE) ..... 10 2011 108 828

(51) Int. Cl.
*H01R 4/24* (2006.01)
*H01R 4/48* (2006.01)

(52) U.S. Cl.
CPC ..... *H01R 4/4818* (2013.01)
USPC ..... 439/441; 439/708; 439/816

(58) Field of Classification Search
CPC ..... H01R 4/4818
USPC ..... 439/441, 708, 816
See application file for complete search history.

(56) References Cited

U.S. PATENT DOCUMENTS

| | | | | |
|---|---|---|---|---|
| 3,528,050 | A * | 9/1970 | Hindenburg | 439/92 |
| 6,814,608 | B2 * | 11/2004 | Kollmann | 439/441 |
| 7,244,140 | B2 * | 7/2007 | Edenharter | 439/441 |
| 8,466,367 | B2 * | 6/2013 | Reibke | 174/135 |
| 2004/0077210 | A1 * | 4/2004 | Kollmann | 439/441 |
| 2007/0072481 | A1 * | 3/2007 | Edenharter | 439/441 |
| 2011/0073364 | A1 * | 3/2011 | Reibke | 174/652 |
| 2013/0029537 | A1 * | 1/2013 | Reibke | 439/708 |

FOREIGN PATENT DOCUMENTS

| | | | |
|---|---|---|---|
| DE | 28 25 291 | A1 | 12/1979 |
| DE | 20 2005 005 369 | U1 | 3/2006 |
| DE | 20 2007 012 429 | U1 | 10/2007 |
| DE | 10 2008 039 232 | A1 | 2/2010 |
| DE | 10 2010 015 457 | A1 | 10/2011 |
| EP | 1 391 965 | A1 | 2/2004 |
| EP | 1 860 735 | A1 | 11/2007 |
| EP | 2 456 011 | A2 | 5/2012 |
| WO | 2011/047740 | A1 | 4/2011 |
| WO | 2011/103997 | A1 | 9/2011 |

* cited by examiner

*Primary Examiner* — James Harvey
(74) *Attorney, Agent, or Firm* — Roberts Mlotkowski Safran & Cole, P.C.; David S. Safran

(57) ABSTRACT

An electrical connection device for connecting at least one stripped conductor end, having a bus bar piece and a clamping spring which compresses an insert conductor end, the bus bar piece having a conductor through opening and a contact section which borders the conductor through opening and extends in the conductor through direction, the clamping spring forming a spring force clamping connection for the electrical conductor. The bus bar piece of the connection device requires less material use since the contact section has two side walls which extend in the longitudinal direction of the bus bar piece, are connected integrally to the bus bar piece and the contact section, and the side walls have a maximum extension in the longitudinal direction of the bus bar piece which is smaller than the longitudinal extension of the conductor through opening.

15 Claims, 7 Drawing Sheets

ELECTRICAL CONNECTION DEVICE

BACKGROUND OF THE INVENTION

1. Field of the Invention

The invention relates to an electrical connection device for connecting at least one stripped conductor end, with a bus bar piece and with a clamping spring which acts as a compression spring on the conductor end, the bus bar piece having a conductor through opening and a contact section which borders the conductor through opening and extends in the conductor through direction, the clamping spring having a clamping leg, an attachment leg and a roughly U-shaped sheet which connects the contact leg and the attachment leg, and the contact section together with the free end of the clamping leg forming a spring force clamping connection for the electrical conductor which is to be connected. In addition, the invention also relates to a bus bar piece with a conductor through opening and an angled contact section for use in an electrical connection device as well as an electrical terminal with a housing and with at least one electric connection device.

2. Description of Related Art

Electrical terminals are known in a host of embodiments. The terminals can be made for connection of an electrical conductor to a circuit board as so-called print terminal or for connection to another conductor as terminal block. Clamping springs are both loop-shaped clamping springs, so-called tension spring clamps, as also roughly U-shaped clamping springs into which rigid conductors or conductors provided with one wire end ferrule can be directly inserted, i.e., without the clamping site having to be opened beforehand with a tool. In the known loop-shaped tension springs, according to their names, the conductor to be connected is drawn by the clamping leg against a bus bar. In contrast, for U-shaped clamping springs the conductor to be connected is pressed by the clamping leg of the clamping spring which is acting as a compression spring against the bus bar or a region of a metal part.

Electrical terminals with a clamping spring which acts as a compression spring in addition to a generally plastic housing have at least one connection device which is held and located within the housing and which consists of a clamping spring and a metal part. The U-shaped clamping spring has a clamping leg and an attachment leg, the clamping leg together with a region of the metal part forming a spring force clamping connection for the stripped electrical conductor which has been inserted into the electrical terminal.

The metal part is used, first of all, for transmission of a current between the contact site with an electrical conductor and a second contact site which can be, for example, a contact site to a circuit board or also a contact site to a second conductor. In the latter case, the metal part is used for transmission of a current from a first electrical conductor which is connected to a first spring force clamping connection to a second conductor which is connected to a second spring force clamping connection. Moreover, the metal part can also be used for holding the clamping spring and especially for lateral guidance of the inserted conductor, for which the metal part, in addition to a base leg and the contact leg, has at least one side wall which runs essentially perpendicular thereto and which prevents the stripped conductor end from being pulled laterally out of the region of the clamping site.

An electrical terminal with this metal part is known, for example, from German Patent Application DE 10 2008 039 232 A1. The metal part has a relatively large-area side wall from which a contact leg, a base leg and an attachment leg are bent on three different sides of the side wall. The contact leg together with the clamping leg of the clamping spring forms the spring force clamping connection for an electrical conductor which is to be connected. The attachment leg of the clamping spring adjoins the attachment leg of the metal part which is opposite the contact leg, as a result of which the clamping spring is held in the metal part. Additional holding and fixing of the clamping spring take place by means of a pin formed in the housing. The current is transmitted from the conductor which has been inserted in the contact site to a second contact site via the base leg which runs perpendicular to the contact leg.

German Utility Model DE 20 2005 005 369 U1, likewise, discloses an electrical terminal which has at least one connection device which consists of a clamping spring and a metal part. The metal part is made as a channel-like, U-shaped trough with a base leg and two longitudinal legs, one end of one longitudinal leg being bent such that the end runs perpendicular to the two longitudinal legs and to the base leg. The end which has been bent, in this way, forms the contact leg which, together with the clamping leg of the clamping spring, forms the spring force clamping connection for the electrical conductor which is to be connected.

A similar metal part is also disclosed in German Utility Model DE 20 2007 012 429 U1. There, the metal part also has a base leg and two longitudinal legs which are bent perpendicular therefrom, the contact leg also being formed by the bent end of a longitudinal leg. Moreover, in this metal part, there is a reinforced bottom section in which a fold section is folded by one of the two longitudinal legs and is located oppositely on the bottom of the base leg.

It is common to the known metal parts that they are punched out of a flat metal strip and are then brought into their finished form by bending-over individual sections. The disadvantage here is that they require increased material use which is not determined solely by the required current carrying capacity.

Moreover, there are also electrical terminals or electrical connection devices which, in addition to a clamping spring, have a bus bar or a bus bar piece as metal part. This terminal with a corresponding connection device is known from German Patent DE 28 25 291 C2. In this known terminal, the bus bar has a conductor through opening through which the stripped conductor end can be inserted. A perforated collar which is closed in a ring shape adjoins the conductor through opening in the conductor through direction. The inner wall of the perforated collar which is opposite the free end of the contact leg forms a contact section which with the clamping leg of the clamping spring forms the spring force clamping connection for an electrical conductor which is to be connected. It is described in this document that it is advantageous that the conductor through opening which is closed in a ring shape with the deployed perforated collar ensures reliable accommodation and guidance of the conductor end which is reliably grasped and clamped by the clamping leg which projects into the conductor through opening without the risk of individuals cores of a flexible conductor being able to give way laterally.

A similar electrical connection device is also disclosed by European Patent Application EP 1 391 965 B1 which also discloses a bus bar with a conductor through opening and a perforated collar which adjoins it and which is closed in a ring shape. If the bus bar piece is relatively narrow, so that the conductor through opening is bordered laterally only by relatively narrow edge webs which run in the longitudinal direction of the bus bar, the execution of the perforated collar which is closed in a ring shape has the advantage that the cross sections of the perforated collar are moreover also current lead cross sections so that in spite of the relatively narrow lateral edge webs altogether a relatively large current lead cross section is available in the longitudinal direction of the bus bar piece for the current transmission.

By using a flat bus bar with a conductor through opening and a perforated collar closed in a ring shape instead of a relatively large-area metal part the required material use can be reduced, but as before the execution of the perforated collar by punching or deep drawing in the production process of the bus bar requires a material feed which is distinctly greater than the width of the bus bar piece which is to be produced.

SUMMARY OF THE INVENTION

Therefore, a primary object of this invention is to provide an electrical connection device of the initially described type and a bus bar piece for this connection device which requires material use as little as possible for the bus bar piece with good functionality.

This object is achieved in the initially described electrical connection device and the indicated bus bar in that the contact section has two side walls which extend in the longitudinal direction of the bus bar piece, the side walls being connected integrally to the bus bar piece and the contact section and having a maximum extension in the longitudinal direction of the bus bar piece which is smaller than the longitudinal extension of the conductor through opening.

In contrast to the connection devices and bus bars known from German Patent DE 28 25 291 C2 and European Patent EP 1 391 965 B1, in the connection device in accordance with the invention the execution of a perforated collar which is closed in a ring shape has been omitted. Within the framework of the invention, it has been recognized that, in the execution of only one contact section with two side walls which extend in the longitudinal direction of the bus bar piece, a relatively large current can also be transmitted in the longitudinal direction of the bus bar piece. By omitting a perforated collar which is closed in a ring shape, however, the material use which is required in the production of the bus bar piece can be distinctly reduced.

As part of the invention, it has been recognized that, in the production of a conductor through opening with a perforated collar which is closed in a ring shape, material also "after-flows" out of the lateral edge webs of the bus bar piece so that the material feed in the production of a, for example, 5 mm wide bus bar piece must be at least 8 mm. In contrast thereto, in the production of the connection device in accordance with the invention and the bus bar piece in accordance with the invention, most of the material for producing the contact section and the side walls does not flow out of the narrow edge webs, but only out of the region of the bus bar piece which adjoins the face side of the conductor through opening. In this way, the feed can be reduced in the production of the bus bar piece, as a result of which the material use per bus bar piece is reduced.

It was stated above that the side walls have a maximum extension in the longitudinal direction of the bus bar piece which is smaller than the longitudinal extension of the conductor through opening. Preferably, the maximum extension of the side walls is smaller than 50% of the longitudinal extension of the conductor through opening, as a result of which the "flow" of material out of the lateral edge webs is reduced, and thus, the required material use is further reduced. The maximum extension of the side walls should, however, be preferably at least 25%, especially at least 40% of the conductor cross section of the electrical conductor which is to be connected. This ensures that the conductor which is to be connected is adequately guided and cannot be forced out laterally on the contact section by the clamping leg. Moreover, the execution of the side walls increases the mechanical stability of the bus bar piece altogether and especially in the region of the spring force clamping connection, compared to a bus bar in which in the region of the conductor through opening only one contact surface is punched out and bent.

According to a first embodiment of both the electrical connection device in accordance with the invention and also the bus bar piece in accordance with the invention, the bus bar piece has only the above described contact section with the two side walls, while on the side of the conductor through opening opposite the contact section, a material section in addition to the surface of the bus bar piece which borders the conductor through opening is not formed. In contrast, in a second embodiment of the electrical connection device and of the bus bar piece on the side of the conductor through opening opposite the contact section, a retaining section which extends in the conductor through direction is made which is adjoined by the attachment leg of the clamping spring. This retaining section has especially the function of improving the fixing of the clamping spring in the conductor through opening of the bus bar piece.

According to a preferred configuration of the second version, the retaining section likewise has two side walls which extend in the longitudinal direction of the bus bar piece and which are connected integrally to the bus bar piece and the retaining section. The extension of the side walls both of the contact section and also of the retaining section is chosen such that the side walls of the contact section and the opposing side walls of the retaining section have a distance relative to one another in the longitudinal direction of the bus bar piece. In this configuration of the bus bar piece, the contact section with its two side walls and the retaining section with its two side walls form a divided or interrupted eyelet which extends in the conductor through direction, the implemented distance between the opposing side walls resulting in that when the eyelet is produced in the bus bar piece most of the material does not flow from the narrow lateral edge webs, but out of the regions of the bus bar piece which border the face sides of the conductor through opening. In this way, in this configuration of the bus bar piece, production of the feed can also be reduced and thus the required material use can be reduced.

The production of the bus bar piece in accordance with the invention is then especially simple when the contact section and the retaining section are made in mirror-image to one another. In particular, this configuration of the bus bar piece can be produced by a shearing and deep drawing process. In doing so, the bus bar piece can be produced from a metal strip, generally, a plurality of bus bar pieces being produced from a larger metal piece by deep drawing and punching-out. Until completion of the individual bus bar pieces, they are generally connected among one another by way of transport pieces or transport edges which support transport of the bus bar pieces and of the metal piece in the transport direction so that the individual bus bar pieces can be produced in several successive method steps while the metal piece is being moved in the transport direction.

In addition to an electrical connection device and a bus bar piece for use in a connection device, the invention also relates to an electrical terminal which in addition to the connection device has another housing in which the connection device, i.e., the bus bar piece and the clamping springs, are located. In the housing, moreover, at least one conductor insertion opening for inserting a conductor end to be connected into the conductor through opening and at least one actuation opening for introducing an actuating tool are formed. Using an actuating tool, for example, the tip of a screwdriver, which has been inserted into the actuation opening, the clamping leg of the clamping spring can be forced back against the spring force of the clamping spring so that the clamping site is opened and a connected conductor can be pulled out of the terminal again. Instead of with a separate actuating tool, the clamping site can also be opened using an actuating button which is movably located in the housing.

According to one advantageous configuration of the electrical terminal, it has not only one connection device, but at least two connection devices. This electrical terminal is then used for connecting at least two stripped conductor ends. For this purpose, in the housing of the terminal, there are two clamping springs and (functionally) two bus bar pieces, the two bus bar pieces being connected integrally with one another so that together they form one bus bar. In the bus bar, there are thus at least two conductor through openings which each have at least one contact section with two side walls, and optionally, also one retaining section each, preferably likewise with two side walls.

In particular, there are now a host of possibilities for embodying and developing the bus bar piece in accordance with the invention and the connection device in accordance with the invention and the electrical terminal. In this respect reference is made to the following description of preferred exemplary embodiments in conjunction with the drawings.

DETAILED DESCRIPTION OF THE INVENTION

Figure 3A:
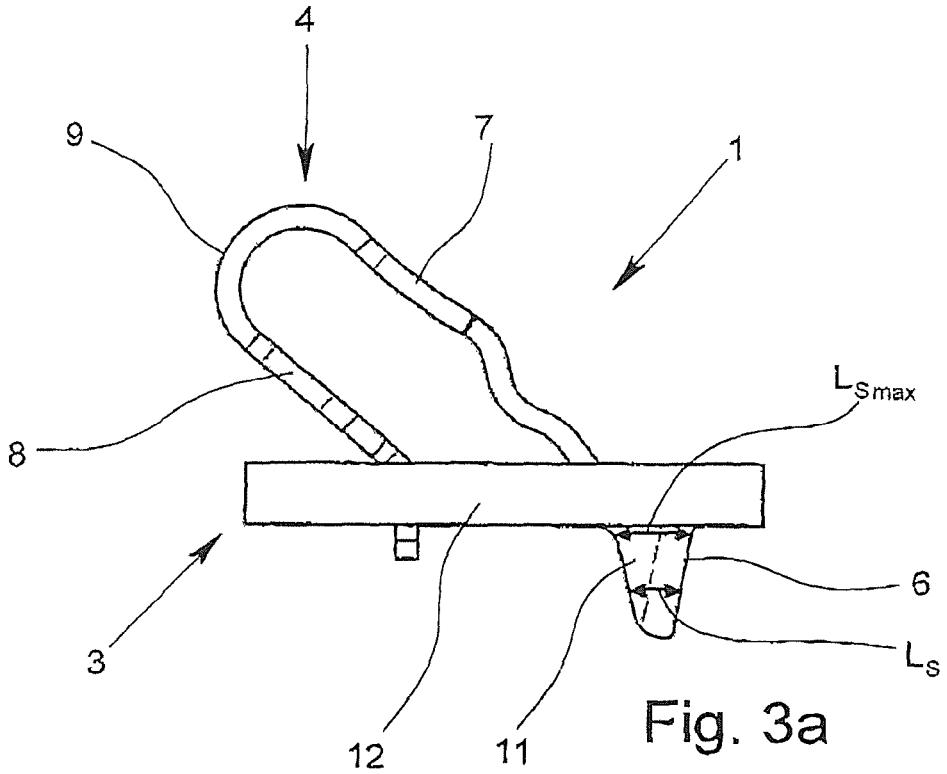
FIG. 3*a* is a side view of the electrical connection device according to FIG. 1 in a side view and FIG. 3*b* is a longitudinal sectional view.
Figure 3B:
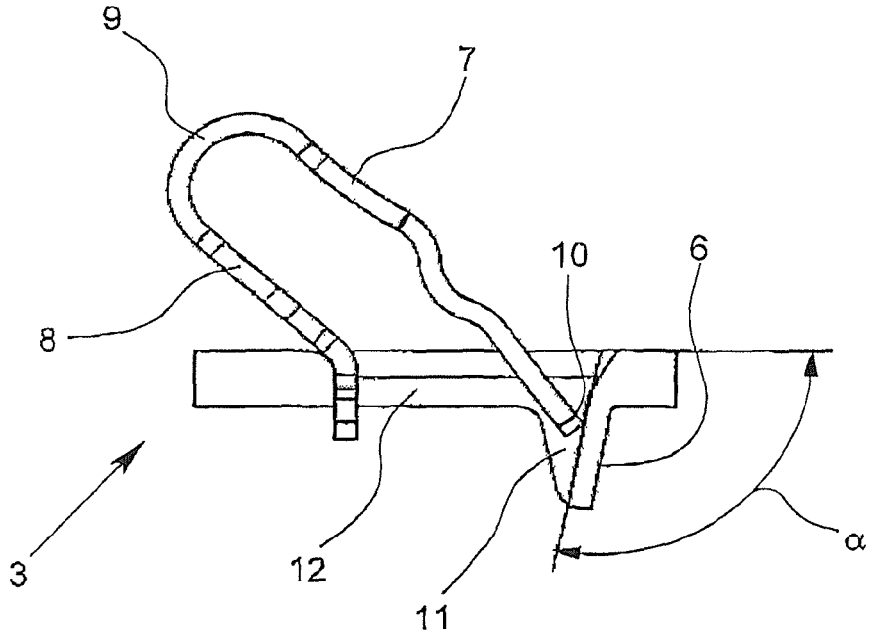
Figure 4A:
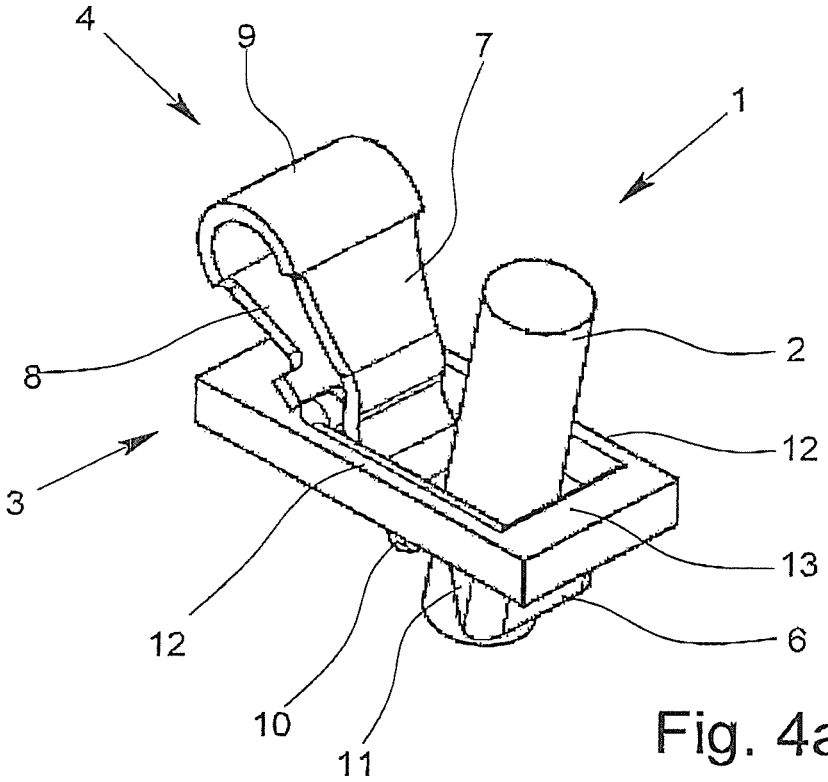
FIG. 4*a* is a perspective view of the electrical connection device according to FIG. 1, with an inserted conductor end
Figure 4B:
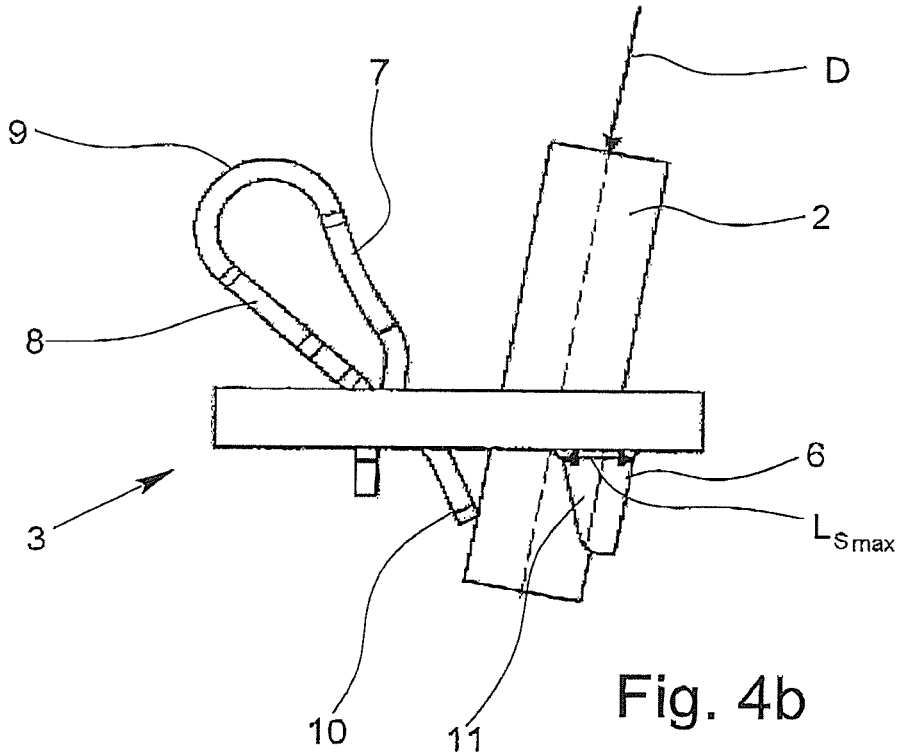
FIG. 4*b* is a side view thereof.

FIGS. 1 to 4 and 5 to 7 show two different exemplary embodiments of an electrical connection device 1 in accordance with the invention for connecting at least one stripped conductor end 2 or one bus bar piece 3 in accordance with the invention, only FIG. 4 showing the connection device 1 with inserted conductor end 2.

The electrical connection device 1, in addition to the bus bar piece 3, has another clamping spring 4 which acts as a compression spring on the conductor end 2 and which is inserted in the conductor through opening 5 which is made in the bus bar piece 3. On one narrow side, the roughly rectangular conductor through opening 5 is adjoined by a contact section 6 which is formed from the material of the bus bar piece 3 by a shearing and deep drawing process and extends in the conductor through direction D (FIG. 4). The roughly U-shaped clamping spring 4 has a clamping leg 7, an attachment leg 8 and a roughly U-shaped arch 9 which connects the clamping leg 7 and the attachment leg 8, the contact leg 6 together with the free end 10 of the clamping leg 7 forming a spring force clamping connection for an electrical conductor 2 which is to be connected.

In the two exemplary embodiments of the connection devices 1 in accordance with the invention which are shown in the figures, the contact section 6 has two side walls 11 which extend in the longitudinal direction of the bus bar piece 3. Here, the side walls 11 are integrally connected both to the bus bar piece 3 and also to the contact section 6, i.e., the contact section 6 and the side walls 11 are jointly formed by a shearing and deep drawing process from the bus bar piece 3.

Figure 1:
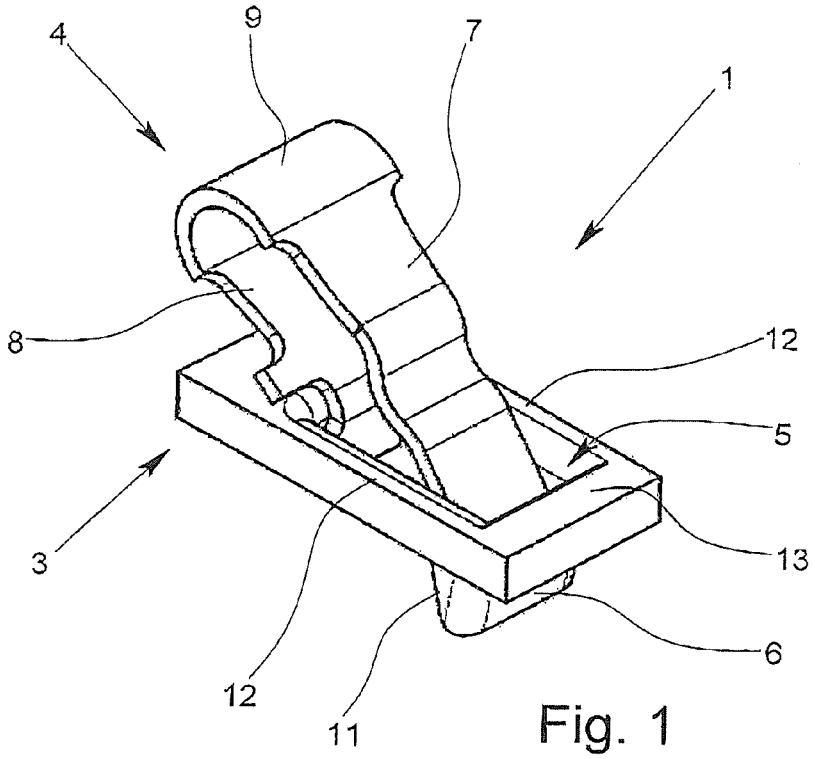
FIG. 1 is a perspective view of a first exemplary embodiment of an electrical connection device.
Figure 2:
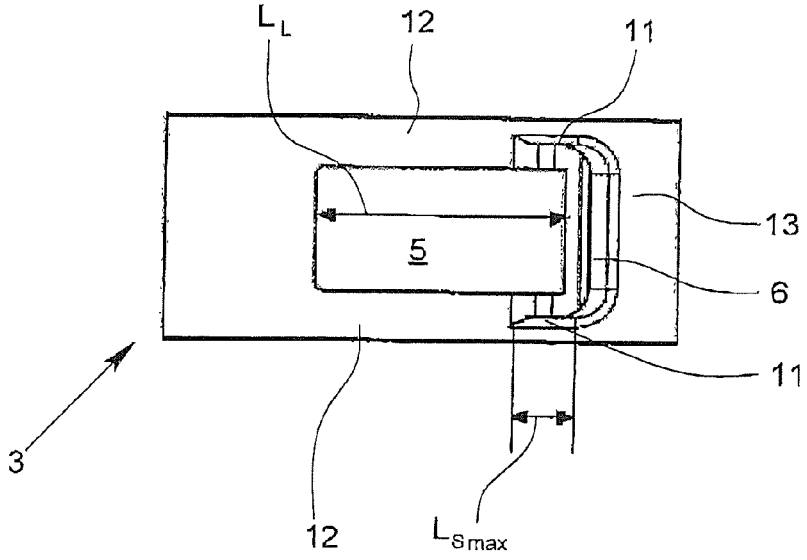
FIG. 2 is a bottom plan view of a bus bar piece of the electrical connection device according to FIG. 1.

As can be recognized, for example, from FIG. 2, the maximum extension $L_{Smax}$ of the side walls 11 in the longitudinal direction of the bus bar piece 3 is distinctly smaller than the longitudinal extension $L_L$ of the conductor through opening 5. In the illustrated exemplary embodiment the maximum extension $L_{Smax}$ is roughly one third of the longitudinal extension $L_L$ of the conductor through opening 5. As is moreover apparent especially from FIG. 3, the extension $L_S$ of the side walls 11 in the conductor through direction D decreases so that the side walls 11 have their maximum extension $L_{Smax}$ directly in the transition to the bus bar piece 3 and to the relatively narrow lateral edge webs 12 which border the conductor through opening 5. While the side walls 11 in the conductor through direction D border the lateral edge webs 12 of the bus bar piece 3, the contact section 6 in the conductor through direction D borders one of the two face-side regions 13 of the bus bar piece 3 which border the conductor through opening 5 in the longitudinal direction.

Figure 7A:
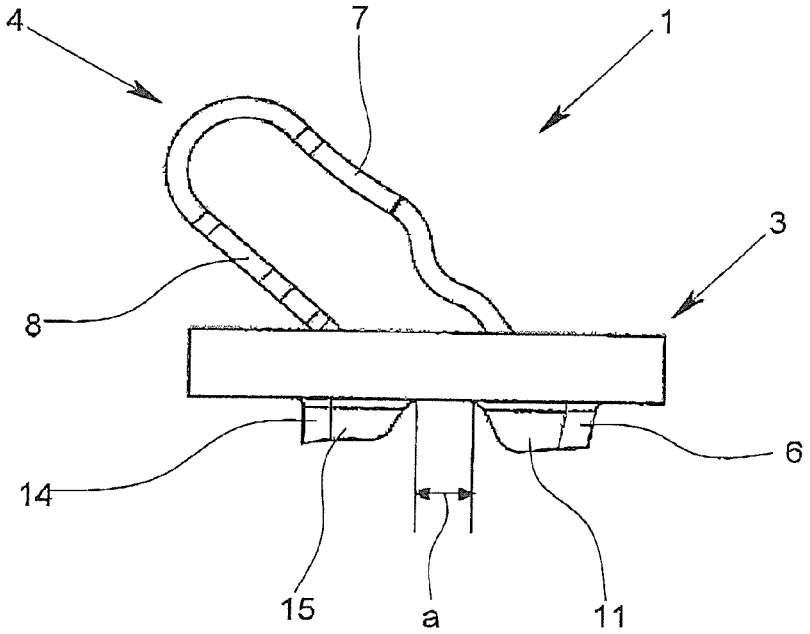
FIG. 7*a* is a side view of the electrical connection device according to FIG. 5
Figure 7B:
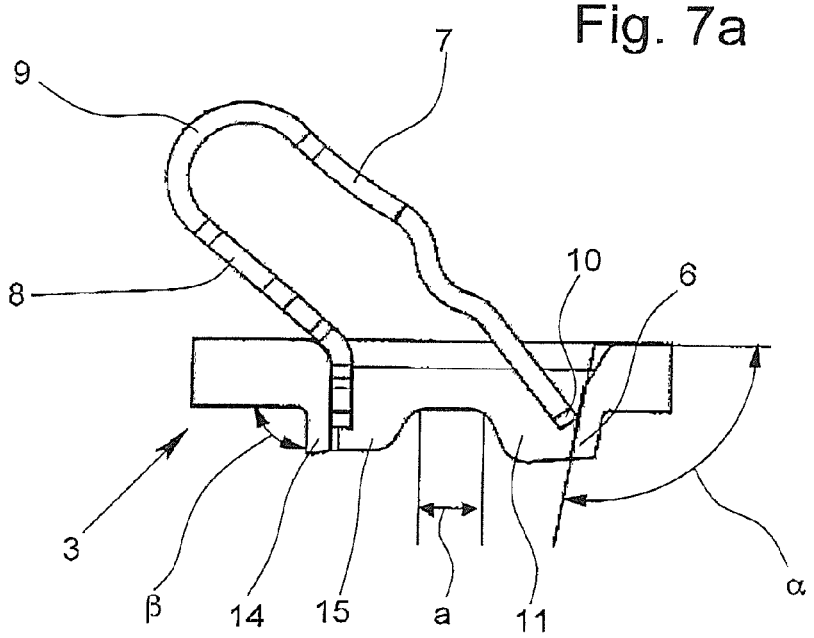
FIG. 7*b* is a longitudinal sectional view thereof.

Moreover, it is apparent from the representation of the connection device 1 according to FIGS. 3*b* & 7*b* that the contact section 6 is angled relative to the bus bar piece 3 such that the angle $\alpha$ between the bus bar piece 3 and the contact section 6 is somewhat larger than 90°.

Figure 5:
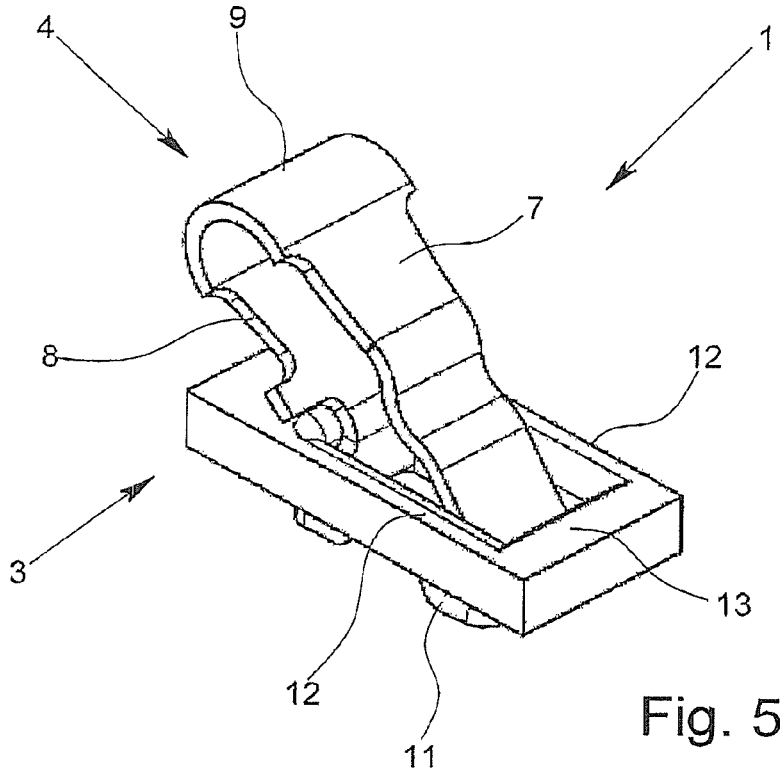
FIG. 5 is a perspective view of a second exemplary embodiment of the electrical connection device.
Figure 6:
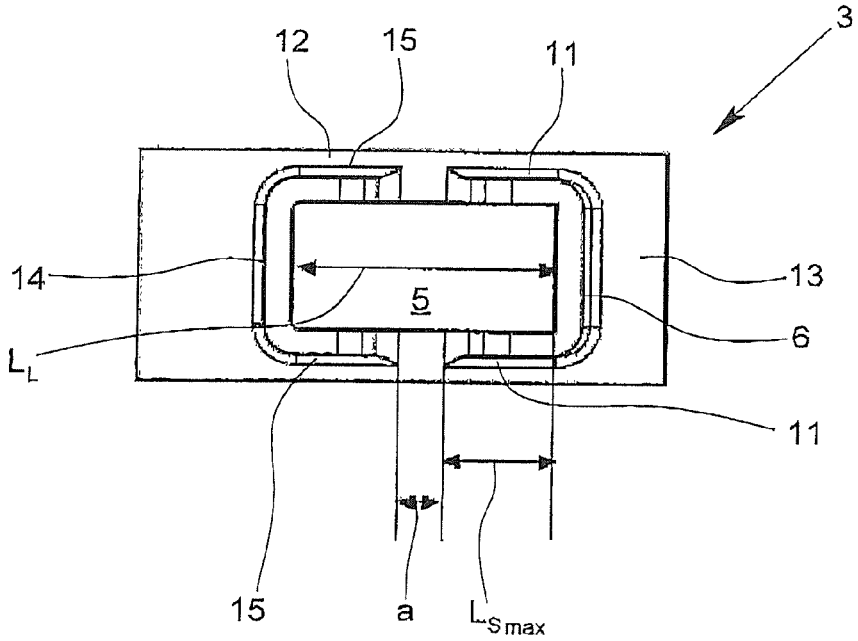
FIG. 6 is a bottom plan view of a bus bar piece of the connection device according to FIG. 5.

In the second exemplary embodiment of the electrical connection device 1 in accordance with the invention which is shown in FIGS. 5 to 7, on the bus bar piece 3 next to the contact section 6, an opposing retaining section 14 is additionally formed which, likewise, extends in the conductor through direction D and adjoins the attachment leg 8 of the clamping spring 4. The retaining section 14 also has two side walls 15 which extend in the longitudinal direction of the bus bar piece 3 and which are connected integrally to the bus bar piece 3 and the retaining section 14.

FIGS. 6 & 7 show that the maximum extension $L_{Smax}$, both of the side walls 11 and also of the side walls 15, is chosen such that the opposing side walls 11, 15 of the contact section 6 and of the retaining section 14 in the longitudinal direction of the bus bar piece 3 have a distance a relative to one another. The bus bar piece 3 which is shown in FIGS. 5 to 7 thus does not have an eyelet which is closed in a ring shape, but an eyelet which is interrupted on both sides in the longitudinal direction of the bus bar piece 3.

In particular, it is apparent from FIG. 7*b*, that the contact section 6 runs at an angle $\alpha$ that is greater than 90° relative to the bus bar piece 3, while the angler β between the bus bar piece 3 and the retaining section 14 is relatively precisely 90°. However, fundamentally, it is also possible for the contact section 6 and the retaining section 14 to both run at an angle of 90° or both at an angle greater than 90° relative to the bus bar piece.

Figure 8:
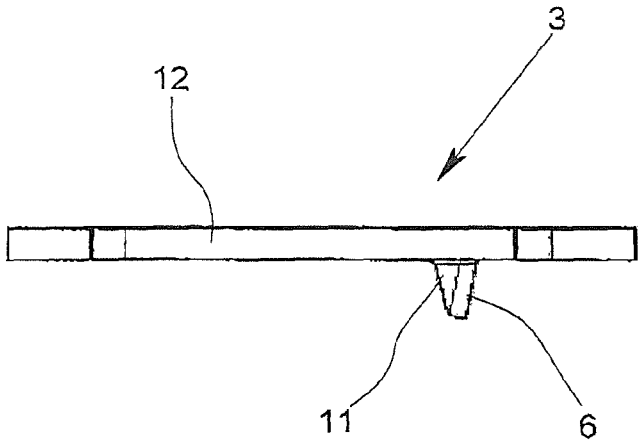
FIG. 8 is a side view of the bus bar piece in accordance with the invention.
Figure 9:
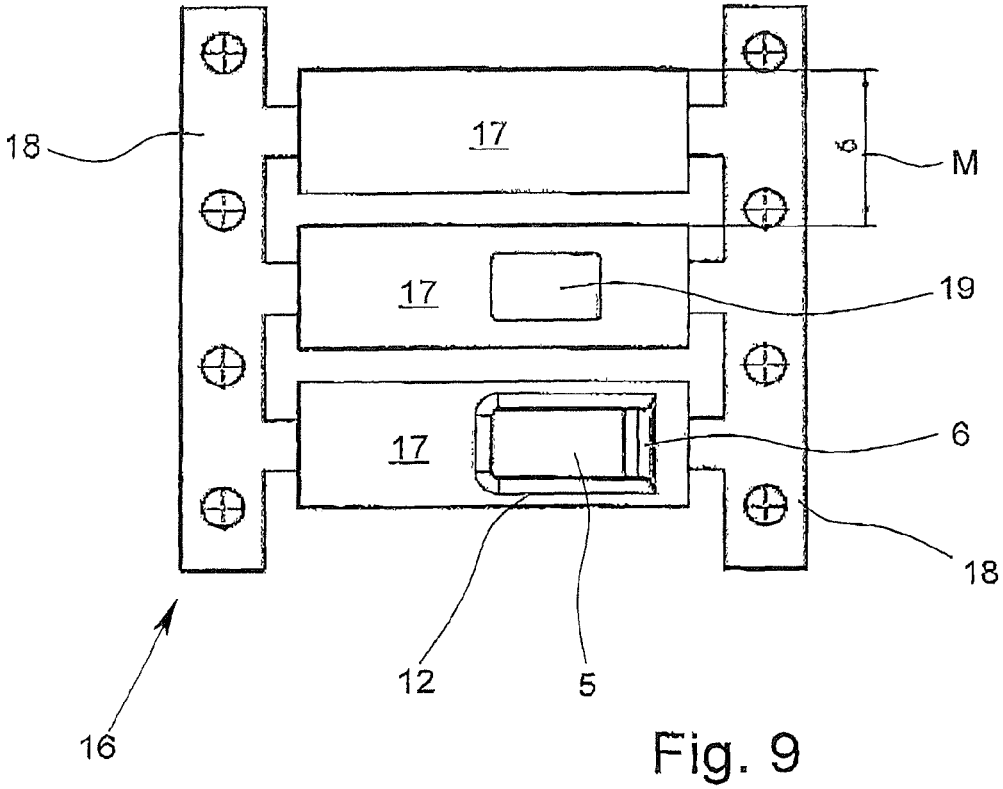
FIG. 9 shows a metal part with several metal strips in different method steps for producing the bus bar piece according to FIG. 8.
Figure 10:
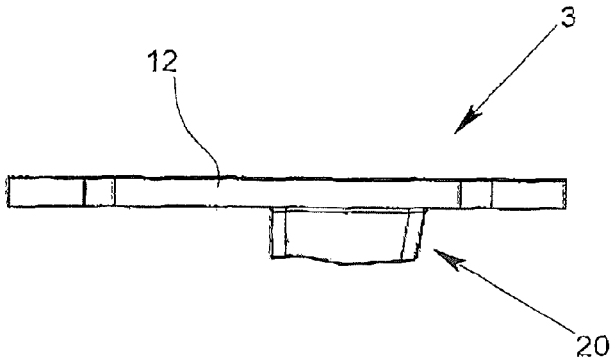
Fig. 10 (Prior Art)
FIG. 10 shows a side view of a bus bar piece according to the prior art.
Figure 11:
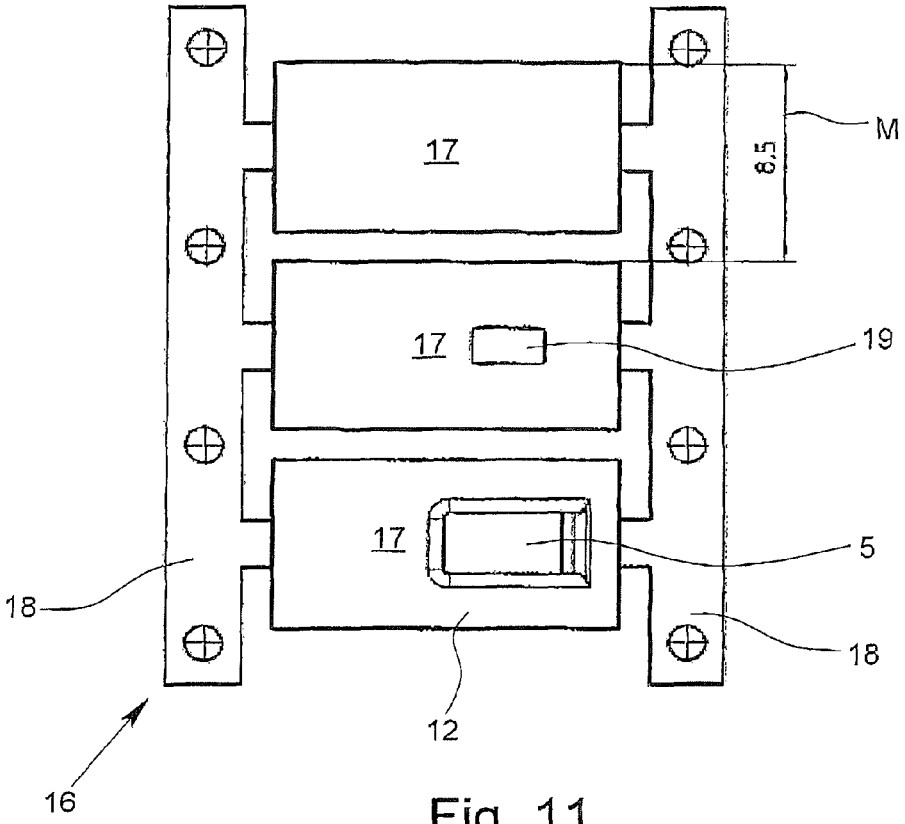
Fig. 11 (Prior Art)
FIG. 11 shows a metal part with several metal strips in different method steps for producing the bus bar piece according to FIG. 10.

A comparison of FIGS. 9 & 11, each of which show the method for producing a bus bar piece 3 in accordance with the invention (FIG. 9) and a bus bar piece (FIG. 11) known from the prior art, illustrates that the material use for producing a bus bar piece 3 in accordance with the invention according to FIG. 8 is much less than the material used for producing a known bus bar piece 3 according to FIG. 10.

The starting point for producing the bus bar piece 3, both for the bus bar piece 3 in accordance with the invention and also in the prior art, is a flat metal piece 16 from which several metal strips 17 have already been partially punched out. The individual metal strips 17 are connected to one another via two edge webs 18 which support transporting of the metal strips 17 in the transport direction so that the individual metal strips 17 can be produced in several successive method steps by punching free, deep drawing, and optionally, additional upsetting and compression methods while the metal part 16 is being moved in the transport direction.

After the first, partial punching of the metal strip 17 out of the metal piece 16, an opening 19 is punched out in the metal strip 17 and is located in the region of the conductor through opening 5, but has smaller dimensions than it. Afterwards, in the bus bar piece 3 in accordance with the invention, by means of a deep drawing process, the contact section 6 and the two side walls 11 are then formed; for this purpose, most of the material does not flow out of the narrow lateral edge webs 12, but instead flows out of the face side 13 of the bus bar piece 3. This leads to the material feed M having to be chosen to be only somewhat greater than the width of the bus bar piece 3.

In contrast thereto, in the production of the perforated collar 20 of the bus bar piece 3 known from the prior art, which collar is closed in a ring shape, material flows not only out of the region of the face sides 13, but also out of the narrow side edge webs 12 of the bus bar piece 3 so that a much larger material feed M must be chosen. While to produce a roughly 5 mm wide bus bar piece 3 with a perforated collar 20 which is closed in a ring shape, a material feed M of 8.5 mm is necessary, in the bus bar piece 3 in accordance with the invention which is shown in FIG. 8 and which has the same width (5 mm), only a material feed M of 6 mm is necessary. As a result the required material use can thus be significantly reduced in the production of the bus bar piece 3 in accordance with the invention.

What is claimed is:

1. An electrical connection device for connecting at least one stripped conductor end, comprising:

a bus bar piece having a conductor through opening and a contact section which borders the conductor through opening and extends in a conductor insertion direction and a clamping spring which acts as a compression spring on a conductor end, the clamping spring having a clamping leg, an attachment leg and a roughly U-shaped arch which connects the clamping leg and the attachment leg, wherein the contact section of the bus bar piece together with a free end of the clamping leg forming a spring force clamping connection for an electrical conductor which is to be connected, wherein the contact section has two side walls which extend in a longitudinal direction of the bus bar piece, wherein the side walls are connected integrally to the bus bar piece and the contact section, and wherein the side walls have a maximum extension in a longitudinal direction of the bus bar piece which is smaller than a longitudinal extension of the conductor through opening.

2. The electrical connection device in accordance with claim 1, wherein the extension of the side walls decreases in the conductor insertion direction.

3. The electrical connection device in accordance with claim 1, wherein the maximum extension of the side walls is at least 25% of a conductor cross section of a electrical conductor which is connectable.

4. The electrical connection device in accordance with claim 1, wherein the maximum extension of the side walls is at least 40% of a conductor cross section of a electrical conductor which is connectable.

5. The electrical connection device in accordance with claim 1, wherein, on a side of the conductor insertion opening opposite the contact section, a retaining section is provided which extends in the conductor insertion direction and which is adjoined by the attachment leg of the clamping spring.

6. The electrical connection device in accordance with claim 5, wherein the retaining section has two side opposed walls which extend in the longitudinal direction of the bus bar piece, wherein the side walls of the retaining section are connected integrally to the bus bar piece, and wherein the side walls of the contact section and the opposed side walls of the retaining section are spaced from each other in the longitudinal direction of the bus bar piece.

7. A bus bar piece with a conductor insertion opening and an angled contact section for use in an electrical connection device for connecting at least one stripped conductor end, wherein the contact section has two side walls which extend in a longitudinal direction of the bus bar piece, the side walls being connected integrally to the bus bar piece and the contact section, and the side walls having a maximum extension in the longitudinal direction of the bus bar piece which is smaller than a longitudinal extension of the conductor insertion opening.

8. The bus bar piece in accordance with claim 7, wherein the contact section runs at an angle greater than 90° relative to the bus bar piece.

9. The bus bar piece in accordance with claim 7, wherein a retaining section is provided that extends in a conductor insertion direction through the insertion opening, the retaining section being located on a side of the conductor insertion opening opposite the contact section.

10. The bus bar piece in accordance with claim 9, wherein the retaining section has two opposed side walls which extend in the longitudinal direction of the bus bar piece and are connected integrally to the bus bar piece, and wherein the retaining section, the side walls of the contact section and the opposed side walls of the retaining section are spaced from each other in the longitudinal direction of the bus bar piece.

11. The bus bar piece in accordance with claim 10, wherein the contact section and the retaining section are arranged in mirror-image relation to one another.

12. The bus bar piece in accordance with claim 7, wherein the contact section and also the retaining section are deep-drawn parts.

13. An electrical terminal with a housing and with at least one electrical connection device, the electrical connection device comprising, a bus bar piece having a conductor through opening and a contact section which borders the conductor through opening and extends in a conductor insertion direction and a clamping spring which acts as a compression spring on a conductor end, the clamping spring having a clamping leg, an attachment leg and a roughly U-shaped arch which connects the clamping leg and the attachment leg, wherein the contact section of the bus bar piece together with a free end of the clamping leg forming a spring force clamping connection for an electrical conductor which is to be connected, wherein the contact section has two side walls which extend in a longitudinal direction of the bus bar piece, wherein the side walls are connected integrally to the bus bar piece and the contact section, wherein the side walls have a maximum extension in a longitudinal direction of the bus bar piece which is smaller than a longitudinal extension of the conductor through opening, and wherein at least one conductor insertion channel for inserting a conductor end to be connected into the conductor insertion opening and at least one actuation opening for introducing an actuating tool being formed in the housing.

14. The electrical terminal in accordance with claim 13, wherein a longitudinal direction of the conductor insertion channel and a lengthwise direction of the contact section are parallel to one another.

15. The electrical terminal in accordance with claim 13, wherein said at least one electrical connection device comprises at least two electrical connection devices.

* * * * *